United States Patent [19]

Honda et al.

[11] Patent Number: 4,686,178

[45] Date of Patent: Aug. 11, 1987

[54] SILVER HALIDE PHOTOGRAPHIC EMULSION AND A PROCESS FOR THE PREPARATION THEREOF

[75] Inventors: Chiba Honda; Koichi Ueda; Akio Suzuki, all of Hino, Japan

[73] Assignee: Konishiroku Photo Industry Co., Ltd., Tokyo, Japan

[21] Appl. No.: 825,766

[22] Filed: Feb. 3, 1986

Related U.S. Application Data

[63] Continuation of Ser. No. 592,705, Mar. 23, 1984, abandoned.

[30] Foreign Application Priority Data

Mar. 28, 1983 [JP] Japan ..... 58-53043

[51] Int. Cl.[4] ..... G03C 1/02

[52] U.S. Cl. ..... 430/569; 430/567

[58] Field of Search ..... 430/567, 569

[56] References Cited

U.S. PATENT DOCUMENTS

| | | | |
|---|---|---|---|
| 3,761,276 | 9/1973 | Evans | 430/567 |
| 3,963,493 | 6/1976 | Vanassche et al. | 430/567 |
| 4,070,190 | 1/1978 | Friedrich et al. | 430/567 |
| 4,284,717 | 8/1981 | Toya et al. | 430/567 |
| 4,335,199 | 6/1982 | Mickewich et al. | 430/567 |
| 4,395,478 | 7/1983 | Hoyen | 430/598 |
| 4,444,877 | 4/1984 | Koitabashi et al. | 430/567 |

FOREIGN PATENT DOCUMENTS

| | | | |
|---|---|---|---|
| 179835 | 11/1982 | Japan | 430/567 |

*Primary Examiner*—John L. Goodrow
*Assistant Examiner*—Mukund J. Shah
*Attorney, Agent, or Firm*—Jordan B. Bierman

[57] ABSTRACT

A process for preparing a monodisperse core/shell type silver halide photographic emulsion comprising silver halide grains wherein the average silver iodide content in the grains is 0.5 to 10 mole % and each of the grains comprises a core portion having no silver iodide. The silver halide grains are caused to grow from seed crystals having substantially no twin crystal by supplying silver ions and halide ions in the presence of protective colloid. The supplying speeds of silver ions and halide ions are gradually increased as the grains grow and the supply of iodide ions in the halide ions is made before the completion of supply of silver ions. The content of ammonia contained in liquid phase emulsion is fixed to the value that is 0.3 normal or more and pAg is fixed to the value that is less than 8 for the supply of iodide ions.

10 Claims, 2 Drawing Figures

SILVER HALIDE PHOTOGRAPHIC EMULSION AND A PROCESS FOR THE PREPARATION THEREOF

This application is a continuation of U.S. application Ser. No. 592,705 filed Mar. 23, 1984, now abandoned, which claims priority of Japanese application Ser. No. 53043/83 filed Mar. 28, 1983.

BACKGROUND OF THE INVENTION

The present invention relates to silver halide photographic emulsion and a process for the preparation thereof.

In the photosensitive materials such as color film, X-ray film and general black and white film or the like for which the high sensitivity is required, silver iodobromide is used and that so-called chemical sensitizing such as reduction sensitization, sulphur sensitization or gold sensitization is applied to the photosensitive materials.

With such chemical sensitizing applied, it is possible to obtain higher sensitivity. At the same time, however, the sensitivity for the red light rises owing to chemical sensitizing alone despite no spectral sensitization applied and the fog takes place when the red safe light is used (U.S. Pat. No. 3,411,914 and Japanese Patent examined Publication No. 8831/1970).

Namely, the operation efficiency under the red safe light which is relatively bright is extremely impeded and unexpected fog problems caused by the safe light may take place during the course of preparing process for photosensitive materials and the course of handling photosensitive materials by the general users, which is dangerous.

As a technology to solve such fog problem caused by the red safe light, there are disclosed some methods in U.S. Patent No. 3411914 and Japanese Patent Publication Open to Public Inspection No. 6073/1971 which include a method to add tetrazaindenes on the half way of chemical sensitizing or a method to provide a dye filter layer. These methods, however, have disadvantages that the thermal stability of photosensitive materials deteriorates considerably and the fog caused by the heat increases.

In Japanese Patent Examined Publication No. 8831/1970, on the other hand, there is disclosed a method in which the chemical sensitizing is conducted with gold (I) mercaptide but this method has disadvantages that the thermal stability deteriorates remarkably and the sensitivity drops for the long time exposure under the low illumination thus a low intensity reciprocity law failure takes place.

In Japanese Patent Examined Publication No. 24937/1981, furthermore, there is disclosed a method wherein the chemical sensitizing is conducted with thiosuccinimide compounds but this method does not give a sufficient sensitivity.

OBJECT OF THE INVENTION

The present invention has been devised in consideration of the circumstance mentioned above and the primary objects thereof are to provide a high speed silver halide emulsion having little fog against the red safe light, little rise in fog against the heat and little low intensity reciprocity law failure and to provide a process for the preparation thereof.

Such objects may be attained by the present invention described below.

Namely, the first invention is;

silver halide photographic emulsion characterized in that said silver halide photographic emulsion consists of mono-disperse core/shell type emulsion of silver halide grains wherein the average silver iodide content in the grains is 0.5–10 mol % and localized portion or portions where silver iodide whose concentration is not less than 20 mol % is localized are existing in the grains and said localized portion or portions are covered by silver halide containing no silver iodide.

Second invention is;

a process for preparing silver halide photographic emulsion characterized in that when preparing mono-disperse core/shell type emulsion of silver halide grains wherein the average silver iodide content in the grains is 0.5–10 mol % and localized portion or portions where silver iodide whose concentration is not less than 20 mol % is localized are existing in the grains and said localized portion or portions are covered by silver halide containing no silver iodide, seed crystals having substantially no twin crystal are caused to grow by supplying silver ions and halide ions in the presence of protective colloid and that the supplying speeds of silver ions and halide ions are gradually increased as grains grow and furthermore the supply of iodine ions in the halide ions is made before the completion of supply of silver ions and the content of ammonia in liquid phase is fixed to the value that is 0.3 normal or more, preferably 0.3 to 2.0 normal, pAg is fixed to the value that is less than 8, preferably from 5 to 8 for the supply of iodine ions.

DETAILED DESCRIPTION OF THE INVENTION

Figure 1:
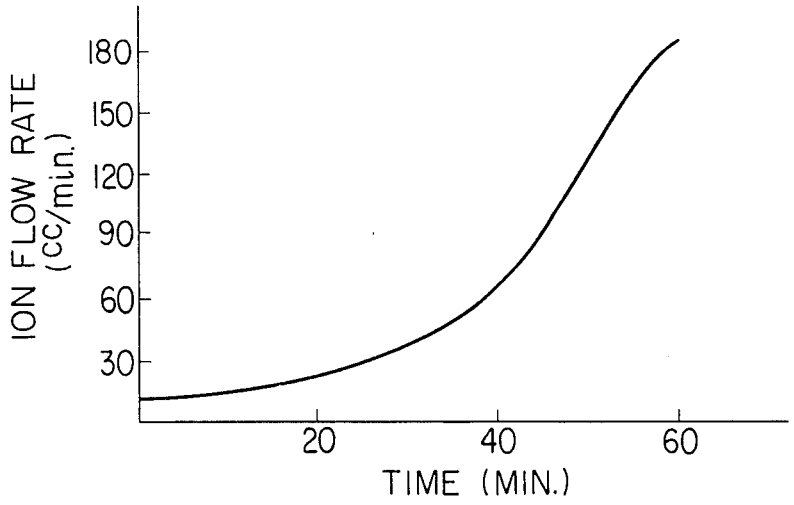
FIG. 1 represents a graph showing the profile of the change in the flux of silver ions and halide ions to be supplied when silver halide grains grow in each sample in the example and FIG. 2 is a graph showing the transmission spectrum distribution of the filter which is for the evaluation of the fog caused by the red safe light in the example and is used to cover the light of illuminating incandescent bulb.

The concrete construction of the present invention will be explained in detail as follows.

Silver halide grains contained in the emulsion of the present invention are silver halide that contains silver iodide and they may be any of silver iodochloride, silver iodobromide or silver chloroiodobromide but silver iodobromide is preferable, in particular, because it gives the one which has a high sensitivity.

Average content of silver iodide in such silver halide grains is 0.5–10 mol % and it preferably is 1–8 mol %. This is because the one within such range has a high sensitivity and little fog and the development progressiveness and fixing property thereof are excellent.

Such silver halide grains have therein a localized portion or portions namely core portion or portions where silver iodide in high concentration of at least 20 mol % or more is localized.

In this case, it is preferable that the core in the grain is located as deep as possible from the external surface of the grain and especially it is preferable to have the shell portion whose thickness is 0.01 μm or more from the external surface.

The core portion may exist in the form of a layer or layers or the entire core may be the localized portion and when a part or all of the core portion excluding the shell portion whose thickness is 0.01 μm or more from the external surface is a localized portion wherein the concentration of silver iodide is 20 mol % or more, it gives a better outcome.

Incidentally, if the concentration of silver iodide in the localized portion is 30 mol % or more, especially 30–40 mol %, it gives a better outcome.

The outer surface of such localized portion is covered by the shell consisting of silver halide containing no silver iodide. Namely, in the preferable mode, the shell portion whose thickness is 0.01 μm, or more from the external surface, especially 0.01–1.5 μm is formed with silver halide (usually, silver bromide) containing no silver iodide.

It is desirable that such silver halide grains are the one which is given a chemical sensitizing in its inside and/or on its outer surface.

As a chemical sensitizing, sulfur sensitizing wherein sodium thiosulfate and thiourea compound etc. are used, gold sensitizing wherein chloroaurate and gold trichloride etc. are used, reduction sensitizing wherein thiourea dioxide, stannous chloride, silver nitrate or electromagnetic radioactive rays are used, palladium sensitizing and selenium sensitizing etc. are given and these may be used individually or in combination of the two or more of them.

If the reduction sensitizing is given to the inside or the surface of the grain and further the gold sensitizing and sulfur sensitizing are given to the surface of the grain, the better outcome may be obtained.

Though there is no limitation, in particular, for the diameter of the silver halide grain, an average grain diameter is 0.2–3 μm under normal conditions.

The emulsion of the present invention is a monodisperse emulsion of such silver halide.

Namely, the emulsion is the one wherein the distribution of the size of silver halide grains dispersed in the protective colloid is narrow and it concretely is the one wherein the fluctuation coefficient ($\sigma\bar{r}$) thereof is not more than 0.2 when an average grain diameter is r and its standard deviation is $\sigma$. Incidentally, the values of $\bar{r}$ and $\sigma$ may be obtained by measuring sides or diameters of grains in the quantity of 500 or more with micrographs or the like.

By using such monodisperse emulsion, it is possible to give sufficiently the sensitizing treatment such as a chemical sensitizing and thus the extremely high sensitivity is obtained and that the high contrast may be kept with little soft gradation caused by the sensitizing treatment. And in this case, the fog problem caused by the red safe light does not take place and the thermal stability thereof is extremely high.

Incidentally, on pages 28–30 in Volume 31 of Journal of the Society of Photographic Science and Technology of Japan, there is a report of the example wherein iodine ions are localized inside the grain in silver iodobromide emulsion. However, in the example of this report, there is no emulsion having the silver iodide concentration profile like the one of the present invention and that it is a polydisperse emulsion with a broad distribution of grain diameter and no chemical sensitizing is given thereto. In such emulsion, therefore, the effect of the present invention cannot be realized.

In Japanese Patent Publication Open to Public Inspection No. 179835/1982, there is described a monodisperse emulsion having a pure silver bromide shell with a thickness of 0.01 μm or more over the core with a silver iodide concentration of 0.5–10 mol % but even such emulsion cannot realize the effect of the present invention as is apparent from the example described later.

It is desirable to follow the following method when preparing silver halide emulsion of the present invention.

With this, it is possible to prepare the monodisperse type and excellent silver halide emulsion stably and speedily. Namely, seed crystals having substantially no twin crystal are caused to grow by supplying ammoniacal silver ions and halide ions in the presence of protective colloid.

In this case, the supplying speeds for silver ions and halide ions are gradually increased as silver halide grains grow.

When increasing the supplying speed gradually, it is usually increased corresponding to the increase of the surface area of each grain based on the growth of silver halide grains without overs and shorts.

When supplying silver ions and halide ions, halide ions containing iodine ions are supplied under the atmosphere that liquid phase ammonia concentration is 0.3 normal or more and pAg is lower than 8.

Supplying of halide ions containing iodine ions should be conducted before the completion of the supply of silver ions. Namely, halide ions (usually, bromine ions only) containing no iodine ions are supplied after the completion of adding halide ions containing iodine ions and thereby silver halide grains are caused to grow.

In such a case, seed crystals including substantially no twin crystals are the one wherein 90% or more of total constituting grains are so-called regular grains and they have the shape of a regular octahedron, a regular hexahedron or tetradecahedron.

As a seed crystal, monodisperse emulsion as stated before is desirable. Further, silver bromide or silver iodobromide is preferable and especially silver iodobromide containing iodine of 40 mol % or less, particularly of 30–40 mol %.

Such seed crystal may enter the growing process immediately after the formation thereof or may enter the growing process after the seed emulsion is desalted and conditions are arranged.

Seed crystals thus obtained are caused to grow using silver in the amount equivalent to 1/250–$\frac{1}{3}$ of the amount of silver used for the growing of seed crystal.

In such a case, the reduction sensitizing may be applied to the seed crystal before the subsequent growth of crystal. The reduction sensitizing method to be used includes a method to use an organic reducing agent such as thiourea dioxide, a method to ripen with low pAg and a method to expose to electromagnetic radioactive rays such as X-rays, γ-rays and visible light or the like.

The source of silver ion of silver halide to be supplied in the growing process of the grain starting from the seed crystal is ammoniacal silver ion solution that is silver nitrate solution to which ammonia is added and ammonia in the amount of ammine complex salt formation equivalent or more is contained therein.

While, the source of halide ion is a halide solution or an ammoniacal halide solution containing various halides such as potassium bromide, potassium iodide, sodium chloride and others individually or in combination thereof.

For the formation of a localized portion or portions whose silver iodide concentration is 20% or more, halide solution to be added according to the present invention, contain iodine ions the amount of which is 20% or more of the amount of silver to be added. In the process wherein silver iodide of 20 mol % or more is localized, the ammonia ion concentration in precipitation liquid phase may be fixed to 0.3N or more in advance and it may be kept at 40° C. with pAg which is lower than 8.

The reason for this is because small grains are generated when silver halide grains grow if ammonia concentration is too low or pAg is 8 or more, thus it is impossible to obtain monodisperse emulsion.

Unlike the present invention, if the localized portion of iodine ion is located on the surface, the effect of the present invention will not be attained, the sensitivity is low and easily suffer from the fog problem caused by the red safe light. In order to attain the effect of the present invention, it is preferable that the localized portion of iodine ion is located as deeply as possible in the grain and the thickness of the shell covering the AgI mixed crystal is 0.0 μm or more. Therefore, it is preferable that halide solution containing iodine ions is added in the early stage of the precipitation process. And the iodine ion concentration of the halide during the formation of the localized portion is generally fixed at 20–30 mol %.

An addition of aforesaid halide ions and ammoniacal silver ion solution to the emulsion containing crystal grains accepting the supply of silver halide and grow with seed crystal as a growing nucleus may be made alternately in a time series manner but it is preferable to use the double-jet method and it is possible to apply a polyjet method wherein two or more of jets are used at the same time.

Various metallic salts or metallic complex salts may be doped into the silver halide emulsion of the present invention during the course of the growth of silver halide grains or after the completion of the growth thereof. For example, metallic salt or metallic complex salt of gold, platinum, palladium, iridium, rhodium, bismuth, cadmium, copper and others or combination thereof can be used.

Further, excessive halides produced when preparing the emulsion of the present invention or salts or compounds such as a nitrate, ammonia and others which are a secondary product or are unnecessary may be removed. As a removing method thereof, a noodle-washing method, a dialysis method or a flocculation method are available.

The emulsion of the present invention has, owing to the chemical sensitizing given thereto, an extremely excellent characteristic.

Among chemical sensitizings, the sulfur sensitizing can be applied by using sodium thiosulfate, thiourea or allylthiourea, for example, and the gold sensitizing can be applied by using sodium chloroaurate or potassium thiocyanoaurate etc., for example. Further, the chemical sensitizing of gold-sulfur sensitizing can be applied by the combined use of above-mentioned sensitizing agents. In this case, it is desirable that ammonium thiocyanate is further added for the chemical sensitizing.

Sensitizing dye or its additives of every kind are further added depending on the purposes to the silver halide photographic emulsion to which the chemical sensitizing is applied. In this case, the technologies described in Research Disclosure Nos. 17643 and 18431, for example, can be applied.

There is no limitation for the type of silver halide photographic material to which the emulsion of the present invention can be applied and any of the photographic materials such as color photographic paper, color negative film, color positive film, black and white film (e.g., radiographic film, graphic art film etc.) and photographic material of diffusion transfer type can employ the emulsion of the present invention usefully.

ACTUAL EFFECT OF THE INVENTION

There is little occurrence of the fog problem caused by the red safe light on the silver halide photographic emulsion of the present invention and photographic materials in which said emulsion is employed. Further, since it is a monodisperse emulsion, sufficiently high sensitivity can be obtained by the chemical sensitizing and the fog problem caused by the storage at high temperature is extremely rare.

While the second invention, the process for the preparation of aforesaid emulsion enables photographic emulsion that needs high sensitivity and contains excellent silver halide grains which are large in diameter and are monodispersive to be prepared stably and speedily.

ACTUAL EXAMPLE OF THE INVENTION

The present invention will be explained in detail as follows referring to the example but the embodiment of the present invention will not be limited to the example alone.

EXAMPLE

Monodisperse cubic system emulsion of silver iodobromide emulsion containing 1.5 mol % of silver iodide whose average diameter is 0.3 μm was obtained through the double-jet method in which the conditions of 60° C., pAg=8 and pH=2.0 were kept. An electron microphotograph of this emulsion showed, after the observation thereof, that the occurrence rate of twin crystal grains was not more than 1%.

After desalting this, silver nitrate solution was added thereto and silver ripening was made under the conditions of 50° C., pAg=3 and pH=6.

This emulsion was regarded as a seed crystal emulsion containing silver corresponding to 50 g of converted silver nitrate. This amount corresponds to 2% of the amount of silver after the growth.

This seed crystal emulsion was dissolved into 8.4 l of 2.5% gelatin water solution kept at 40° C. and ammonia water equivalent to 0.2 normal was added thereto. Further, glacial acetic acid was used to make the pH the value of 9.0 and then ammoniacal silver ion water solution at 3.2 normal and halide water solution were added through the flux profile shown in FIG. 1 and then were stirred and mixed.

As a halide water solution, the mixed liquid of KBr and KI containing iodine ion that is 2% of molecular weight of silver ion to be used was employed.

The pAg was kept constant at 9.0 and pH was changed from 9 to 8 corresponding to the adding amount of ammoniacal silver ion.

The grain thus obtained was the one wherein silver iodides were distributed over the entire part of the grain and an average silver iodide content thereof was 2 mol %, an average grain diameter $\bar{r}$ was 1.21σm and $\mu\bar{r}$ was 0.12.

Through the flocculation method, excessive water-soluble salts were removed from the emulsion thus obtained and ammonium thiocyanate, chloroauric acid and sodium thiosulfate were added thereto and gold-sulfur sensitizing was given thereto.

Further, 4-hydroxy-6-methyl-1,3,3a,7-tetrazaindene was added thereto and after general photographic additives such as spreading agent, thickener and hardener etc. were added, precoated polyethylene terephthalate film base was coated and dried in an ordinary manner so that the silver amount thereon was 60 mg/100 $cm^2$, thus the sample for sensitometry was obtained and it was designated as a comparative sample 1-1.

While the samples 1-2–1-5 were obtained by changing the stipulated amount of ammonia to be added first as seed crystal emulsion grows as Table I below shows and by controlling the concentration of iodine ion shown when halide was added so that AgI will be localized within the range of 0.5–0.8 μm from the center with the concentration shown in Table I and AgBr only will be distributed within the range from the point which is 0.8 μm or more from the center up to the external surface.

Incidentally, pAg and pH shown when iodine ion was added are indicated in Table I below. When high concentration iodine ions were added, the flowing amount thereof was fixed to be one-third of that for comparative sample 1-1.

Incidentally, each sample was given the gold-sulfur sensitizing like the comparative sample and also was given the same additives.

TABLE I

| Sample No. | amount of ammonia to be added first (N) | localized portion AgI (mol %) | when adding iodine ion pAg | when adding iodine ion pH | $\bar{r}$ | $\sigma/\bar{r}$ |
|---|---|---|---|---|---|---|
| 1-1 | 0.2 | — | 9 | 9.0–8.0 | 1.21 | 0.12 |
| 1-2 | 0.2 | 10 | 8.0 | 9.5 | 1.21 | 0.13 |
| 1-3 (present invention) | 0.3 | 20 | 7.8 | 9.5 | 1.20 | 0.11 |
| 1-4 (present invention) | 0.6 | 30 | 7.4 | 9.7 | 1.22 | 0.11 |
| 1-5 (present invention) | 0.9 | 36 | 7.6 | 9.7 | 1.21 | 0.12 |

For the sensitometry, the light source having the color temperature of 5400° K. was used for the exposure and 1/100 sec. exposure was made through the optical wedge. The exposure value was 3.2CMS.

Then, the development was made for 30 seconds at 35° C. using the following developer.

| [developer] | |
|---|---|
| anhydrous potassium sulfite | 50 g |
| hydroquinone | 10 g |
| boric acid anhydride | 1 g |
| potassium carbonate monohydrate | 15 g |
| 1-phenyl-3-pyrazolidone | 0.5 g |
| potassium hydroxide | 4 g |
| 5-methyl-benztriazole | 0.05 g |
| potassium bromide | 5 g |
| glutaraldehyde bisulfite | 15 g |
| glacial acetic acid | 8 cc |
| add water to make 1 l. | |

The sensitometry sample was kept for three days under the conditions of 60° C. and 50% of relative humidity and the rise in the fog density was measured (incubation test).

Figure 2:
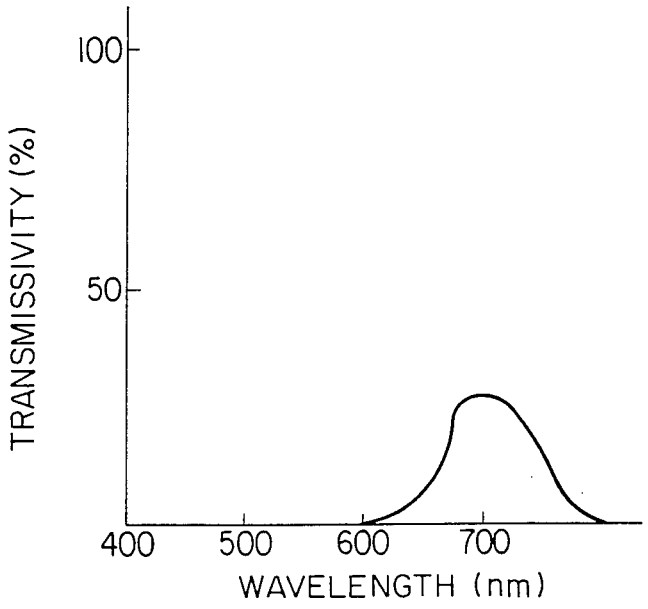

Further, the red light was casted from the incandescent lamp for five minutes through the filter having the transmissivity shown in FIG. 2 and the density of the fog caused by the red safe light was measured.

Table II shows the results thereof.

TABLE II

| sample No. | sensitivity | incubation test rise in fog density | red light rise in fog density |
|---|---|---|---|
| 1-1 | 100 | 0.12 | 0.72 |
| 1-2 | 125 | 0.08 | 0.50 |
| 1-3 (present invention) | 130 | 0.04 | 0.10 |
| 1-4 (present invention) | 132 | 0.02 | 0.05 |
| 1-5 (present invention) | 130 | 0.02 | 0.04 |

It is observed that the samples 1-3–1-5 of the present invention show the higher sensitivity, the lower rise in the fog caused by heat and the lower rise in the fog caused by the red light than those of the samples 1-1 and 1-2.

COMPARATIVE EXAMPLE

Comparative samples were obtained in the same manner as the samples 1-4 in the example.

In the sample 2-1, the completion time for adding iodine ions was synchronized with the completion time for adding silver ions (sample 2-1).

As shown in Table III, comparative samples 2-2–2-3 were obtained by changing the precipitation conditions with a standard of the sample 1-4. In this case, samples 2-1 and 1-4 only were monodisperse emulsion.

Sensitometry test, oven test and a test of the fog caused by the red light which were the same as those in the example were made.

The results thereof are shown in Table IV.

TABLE III

| sample No. | amount of ammonia to be added first (N) | localized portion AgI (mol %) | when adding iodine ion pAg | when adding iodine ion pH | $\bar{r}$ | $\sigma/\bar{r}$ |
|---|---|---|---|---|---|---|
| 1-1 | 0.2 | — | 9 | 9.0–8.0 | 1.21 | 0.12 |
| 2-1 | 0.6 | — | 7.6 | 9.7 | 1.23 | 0.14 |
| 2-2 | 0.3 | 30 | 7.6 | 9.7 | 1.15 | 0.32 |
| 2-3 | 0.6 | 30 | 8.5 | 9.7 | 1.13 | 0.28 |
| 1-4 (present invention) | 0.6 | 30 | 7.6 | 9.7 | 1.22 | 1.11 |

TABLE IV

| sample No. | sensitivity | oven test rise in fog density | red light rise in fog density |
|---|---|---|---|
| 1-1 | 100 | 0.12 | 0.75 |
| 2-1 | 60 | 0.23 | 1.10 |
| 2-2 | 80 | 0.10 | 0.20 |
| 2-3 | 85 | 0.11 | 0.25 |
| 1-4 (present invention) | 132 | 0.03 | 0.04 |

The results shown in Table IV clearly indicate the effect of the present invention.

What is claimed is:

1. A process for preparing a monodisperse core/shell type silver halide photographic emulsion comprising silver halide grains wherein an average silver iodide content in said grains is 0.5 to 10 mole % and each of said grains comprises a core portion having silver iodide of 30–40 mole % and a shell portion having no silver iodide, wherein silver halide grains are caused to grow from seed crystals having substantially no twin crystal by supplying silver ions and halide ions in the presence of protective colloid, and the supplying speeds of silver ions and halide ions are gradually increased as said grains grow and the supply of iodide ions in the halide ions is made before the completion of supply of silver ions and the content of ammonia contained in liquid phase emulsion is 0.3 to 2.0 normal and pAg is from 5 to 8 for the supply of iodide ions.

2. A process according to claim 1, wherein said silver halide grains are grains of silver iodobromide.

3. A process according to claim 1, wherein the monodispersibility of said silver halide grains is 0.2 or less in the fluctuation coefficient thereof.

4. A process according to claim 1, wherein content of ammonia contained in said liquid phase emulsion is fixed to the value of 0.4 to 1.0.

5. A process according to claim 1, said value of pAg is 6.5 to 7.8.

6. A process according to claim 1, wherein said seed crystals having substantially no twin crystal are caused to grow by supplying silver ions and halide ions at the same time in the presence of protective colloid.

7. A process according to claim 1, wherein said grains comprises shell portion therein having thickness of 0.01 to 1.5 $\mu$m.

8. A process according to claim 1, wherein average grain diameter of said grains is 0.2 to 3 $\mu$m.

9. A process according to claim 1, wherein said shell portion consist of silver bromide.

10. A monodispersed core/shell type silver halide photographic emulsion comprising silver halide grains having an average silver iodide concentration from 0.5 to 10 mole %, said silver iodide being contained entirely within said core portion in a concentration of at least 30 to 40 mole %, said grains resulting from the process comprising beginning with seed crystals having substantially no twin crystal and growing silver halide grains therefrom by supplying silver ions and halide ions in the presence of a protective colloid, gradually increasing the speed of supplying said silver ions and said halide ions as said grains grow, said halide ions comprising iodide ions and exhausting said iodide ion supply before exhausting said silver and the total halide supply, said liquid phase emulsion containing ammonia therein in an amount of 0.3 to 2.0 normal, and wherein a pAg is from 5 to 8 while iodide ions are being supplied.

* * * * *